US010465716B2

(12) United States Patent
Vo et al.

(10) Patent No.: US 10,465,716 B2
(45) Date of Patent: Nov. 5, 2019

(54) COMPRESSOR CASING

(71) Applicant: CORPORATION DE L'ECOLE POLYTECHNIQUE DE MONTREAL, Montreal (CA)

(72) Inventors: Huu Duc Vo, Montreal (CA); Mert Cevik, Montreal (CA); Engin Erler, Montreal (CA)

(73) Assignee: PRATT & WHITNEY CANADA CORP., Longueuil, QC (CA)

( * ) Notice: Subject to any disclaimer, the term of this patent is extended or adjusted under 35 U.S.C. 154(b) by 389 days.

(21) Appl. No.: 14/541,706

(22) Filed: Nov. 14, 2014

(65) Prior Publication Data

US 2016/0040546 A1 Feb. 11, 2016

Related U.S. Application Data

(60) Provisional application No. 62/034,965, filed on Aug. 8, 2014.

(51) Int. Cl.
*F04D 29/68* (2006.01)
*F04D 29/52* (2006.01)

(52) U.S. Cl.
CPC ..... *F04D 29/685* (2013.01); *F04D 29/526* (2013.01); *F05D 2250/182* (2013.01)

(58) Field of Classification Search
CPC .... F04D 29/685; F04D 29/526; F04D 29/545; F04D 29/403; F04D 29/661; F04D 29/681; F04D 29/547; F01D 11/08
See application file for complete search history.

(56) References Cited

U.S. PATENT DOCUMENTS 4,764,089 A * 8/1988 Strangman ..... F01D 11/122 415/173.4
4,767,266 A * 8/1988 Holz ..... F01D 11/08 277/412
6,234,747 B1 5/2001 Mielke et al.
6,350,102 B1 * 2/2002 Bailey ..... F01D 5/20 415/173.5

(Continued)

FOREIGN PATENT DOCUMENTS

EP 0774050 3/1999

OTHER PUBLICATIONS

Ho, H.D., Tan, C..S. and Greitzer, E.M., 2008, "Criteria for Spike Initiated Rotating Stall", ASME Journal of Turbomachinery, Vo. 130, No. 1, 9 pages.

(Continued)

*Primary Examiner* — Brian P Wolcott
(74) *Attorney, Agent, or Firm* — Norton Rose Fulbright Canada LLP

(57) ABSTRACT

A gas turbine engine shroud for surrounding one of a rotor and a stator having a plurality of radially extending airfoils is provided. The shroud includes an annular body defining an axial and a radial direction. The body has a radially inner surface and a plurality of indentations is annularly defined therein. Each of the plurality of indentations has a depth of an order of magnitude of a clearance between the one of the rotor and the stator and the inner surface. The plurality of indentations is defined in a region of the inner face defined axially between projections of leading and trailing edges of the airfoils onto the inner surface of the annular body.

19 Claims, 7 Drawing Sheets

(56) References Cited

U.S. PATENT DOCUMENTS

| | | | | |
|---|---|---|---|---|
| 6,499,940 | B2 | 12/2002 | Adams | |
| 8,257,022 | B2 * | 9/2012 | Guemmer | F04D 29/526 415/144 |
| 8,337,146 | B2 | 12/2012 | Yu | |
| 8,602,720 | B2 | 12/2013 | Goswami et al. | |
| 8,777,558 | B2 | 7/2014 | Brunet et al. | |
| 9,004,859 | B2 * | 4/2015 | Shahpar | F01D 11/08 415/220 |
| 2007/0147989 | A1 | 6/2007 | Collins | |
| 2008/0044273 | A1 | 2/2008 | Khalid | |

OTHER PUBLICATIONS

Thompson, D.W., King, P.I. and Rabe, D.C., 1998, "Experimental Investigation of Stepped Tip Gap Effects on the Performance of a Transonic Axial-Flow Compressor Rotor", ASME Journal of Turbomachinery, vol. 120, pp. 477-486.

Muller, M.W., Schiffer, H.-P. and Hah, C., 2007, "Effect of Circumferential Grooves on the Aerodynamic Performance of an Axial Single-Stage Transonic Compressor", Paper GT2007-27365, Proceedings of the ASME Turbo Expo 2007, Montreal, Canada, May 14-17, 2007.

Zhang, H and Ma, H., 2007, "Study of Sloped Trench Casing Treatment on Performance and Stability of a Transonic Axial Compressor", Paper GT2007-28140, Proceedings of the ASME Turbo Expo 2007, Montreal, Canada, May 14-17, 2007.

* cited by examiner 31
32
24
38
40
42A
42B
42C
43A
43B
43C
Pte
Ple
D
W
ε
Wr

COMPRESSOR CASING

CROSS-REFERENCE TO RELATED APPLICATIONS

This application claims priority to U.S. provisional application No. 62/034,965, filed on Aug. 8, 2014, the entire contents of which are incorporated by reference herein.

TECHNICAL FIELD

The application relates generally to gas turbine engines and, more particularly, to compressor casings.

BACKGROUND OF THE ART

Tip clearance flow is the flow that passes through the gap between a rotor blade tip and a stationary casing (or a stator blade root and a rotating hub). This flow may be a source of performance and stability loss in compressors. Temporary increases in tip clearance size during transient gas turbine engine operation and permanent tip clearance augmentation from wear over the life of the engine may be detrimental to fuel consumption and surge margin.

SUMMARY

In one aspect, there is provided gas turbine engine shroud for surrounding one of a rotor and a stator having a plurality of radially extending airfoils, the shroud comprising: an annular body defining an axial and a radial direction, the body having a radially inner surface, and a plurality of indentations annularly defined therein, each of the plurality of indentations having a depth of an order of magnitude of a clearance between the one of the rotor and the stator and the inner surface, the plurality of indentations being defined in a region of the inner face defined axially between projections of leading and trailing edges of the airfoils onto the inner surface of the annular body.

In yet another aspect, there is provided a gas turbine engine comprising: one of a stator and a rotor having a plurality of radially extending airfoils; and an annular casing surrounding the one of the stator and the rotor, the annular casing having: an annular body defining an axial and a radial direction, the body having an inner surface and a plurality of indentations annularly defined therein, the plurality of indentations having a depth of an order of magnitude of a clearance between the one of the rotor and the stator and the inner surface, the plurality of indentations being defined in a region of the inner surface defined axially between projections of leading and trailing edges of the blades onto the inner surface of the casing.

In still another aspect, there is provided a method of forming an annular casing for surrounding one of a rotor and a stator of a gas turbine engine, the method comprising: forming a plurality of indentations annularly defined on an inner surface of the annular casing with a depth at an order of magnitude of a clearance between the one of the rotor and the stator and the inner surface, the plurality of indentations being defined in a region of the inner face defined axially between projections onto the inner surface of the casing of leading and trailing edges of airfoils of the one of the rotor and the stator.

DESCRIPTION OF THE DRAWINGS

Reference is now made to the accompanying figures in which.

DETAILED DESCRIPTION

Figure 1:
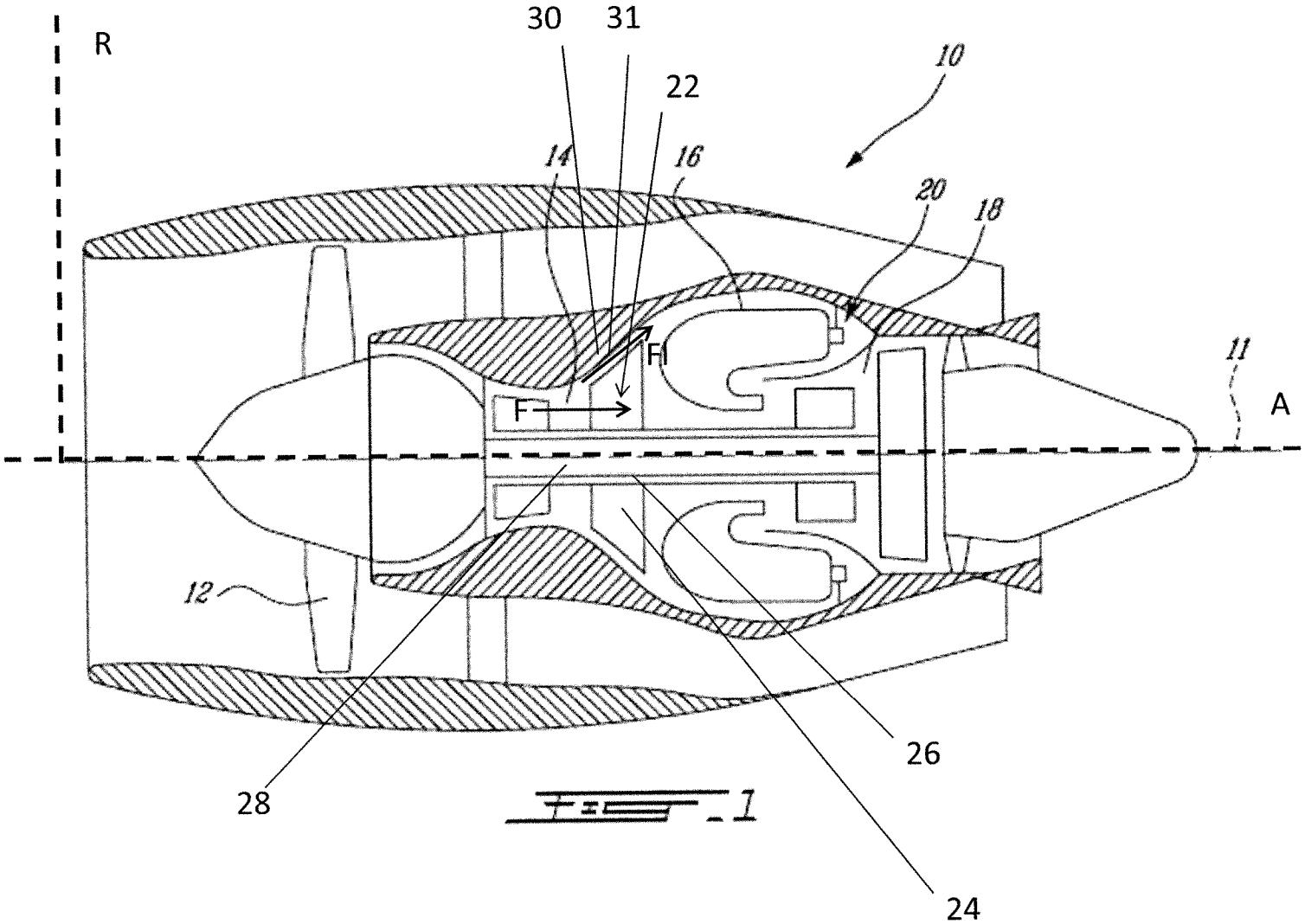
FIG. 1 is a schematic cross-sectional view of a gas turbine engine.

FIG. 1 illustrates a gas turbine engine 10 of a type preferably provided for use in subsonic flight, generally comprising in serial flow communication along a centerline 11: a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. The centerline 11 defines an axial direction A and a radial direction R.

The compressor section 14 including a plurality of rotors 22 (only one being schematically shown). The rotor 22 includes a plurality of circumferentially distributed blades 24 extending radially from an annular hub 26. The hub 26 is supported by a shaft 28 for rotation about the centerline 11 of the engine 10. An annular compressor casing 30 (also known as shroud) surrounds the compressor blades 24.

Figure 2:
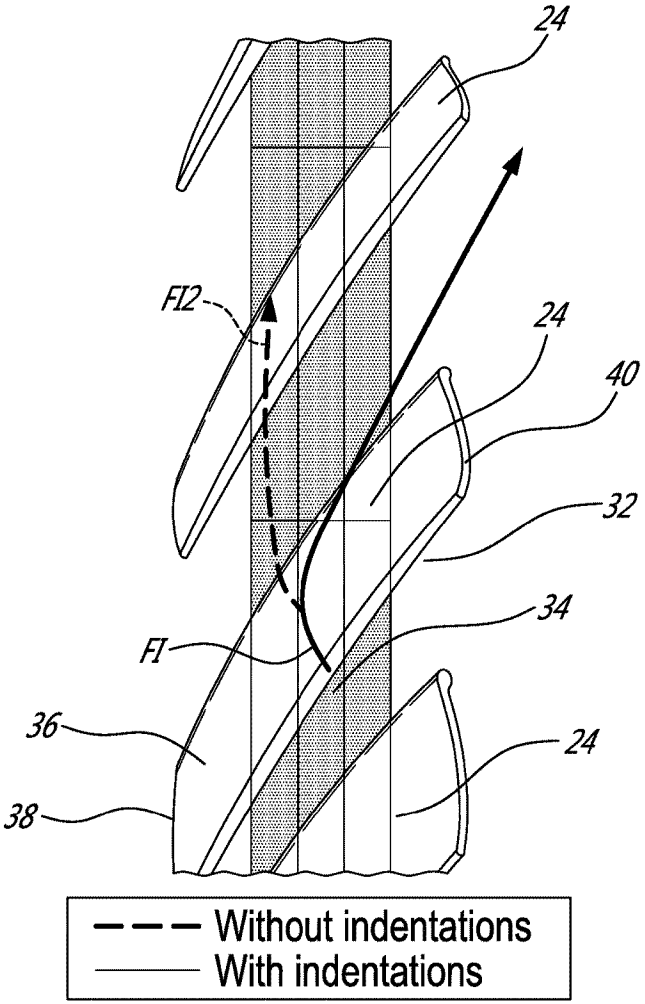
FIG. 2 is a schematic top partial view of a compressor rotor of the engine of FIG. 1 with dashed line/arrow illustrating the double tip leakage phenomenon.

Referring to FIG. 2, each of the blades 24 is airfoil shaped and includes a pressure side 34 and an opposed suction side 36, and a leading edge 38 and a trailing edge 40 defined at the junction of the pressure side 34 and the suction side 36.

A tip 32 of the blade 24 is spaced radially from an inner face 31 of the compressor casing 30 to provide a tip clearance ε (shown in FIG. 3). The hub 26 and annular casing 30 define inner and outer boundaries, respectively, for channeling a flow of air F through the compressor 14. The flow of air F is generally aligned with the centerline 11 of the gas turbine engine 10. The flow F may leak (leakage flow Fl) through the tip clearance ε which may reduce performance and aerodynamic stability of the compressor 14 (i.e. detrimental to engine fuel consumption and surge margin). The tip clearance ε may not be constant over time and may even increase. For example, the tip clearance size ε may temporary increase during transient gas turbine engine operation. In another example, tip clearance ε may permanently increase from wear over the life of the engine.

Sensitivity of performance and aerodynamic stability to tip clearance, may be reduced by increased incoming meridional momentum (e.g. by having forward chordwise sweep of the blade 24) in the rotor tip region and reduction/elimination of double tip leakage flow. Double tip leakage is a phenomenon where tip clearance flow exits one blade's tip 32 clearance ε and enters the tip clearance ε of the adjacent blade 24 of the same blade row instead of convecting downstream out of the blade passage. Double tip leakage is illustrated in FIG. 2 by the arrow Fl2.

Figures 3A, 3B, 3C:
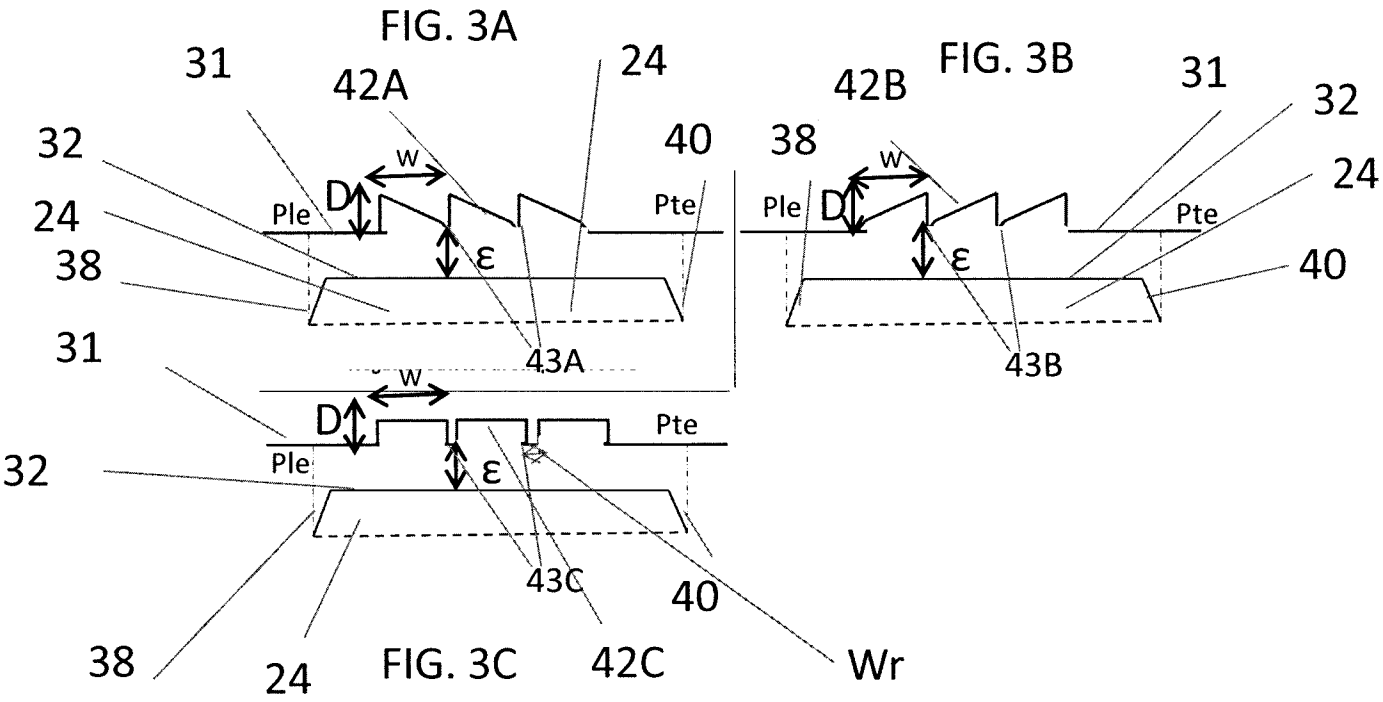
FIGS. 3A to 3C illustrates various embodiment of a casing surrounding the compressor rotor of FIG. 2.
Figure 4:
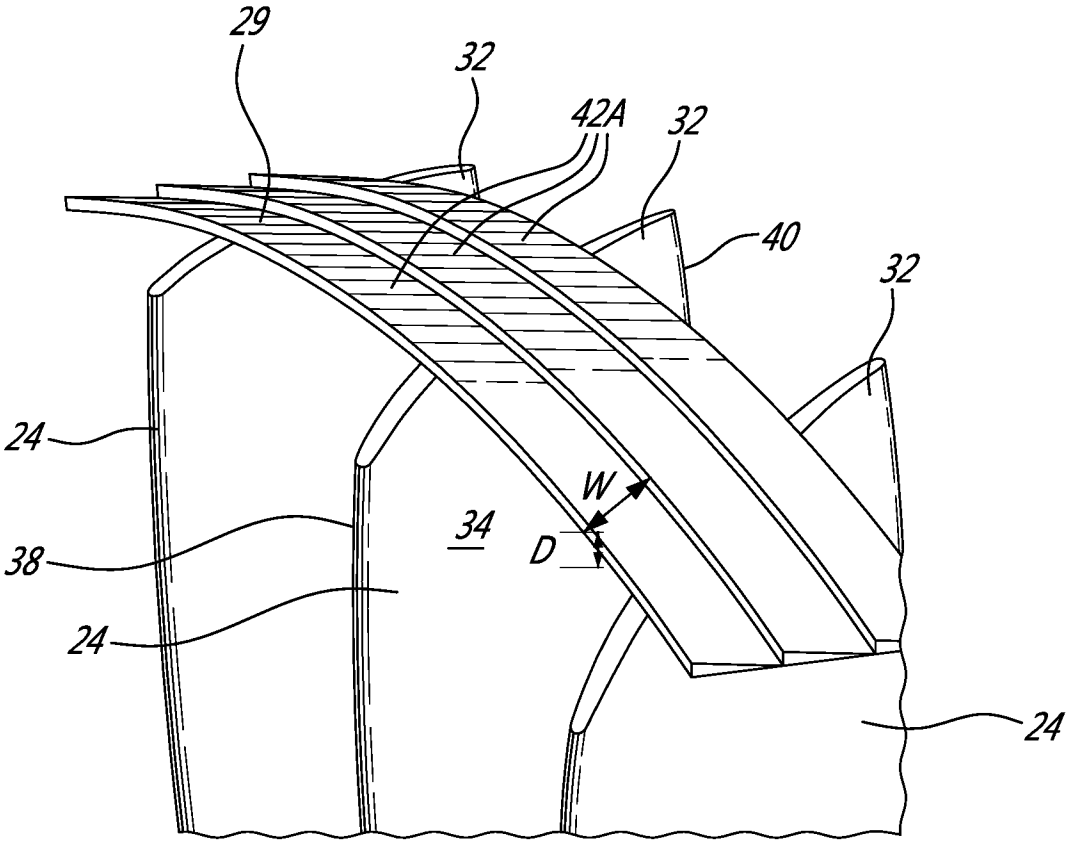
FIG. 4 is a schematic perspective top view of the compressor rotor of FIG. 2 and the casing of FIG. 3A.

Turning now to FIGS. 3A to 4, various treatments on the inner face 31 the casing 30, which may reduce sensitivity to tip clearance, are presented.

Referring more specifically to FIG. 3A, the annular casing 30 includes a plurality of indentations 42A. The indentations 42A are annular (i.e. circumferential) indentations in the inner face 31 of a body 29 (partly shown in FIG. 4) forming the casing 30 (i.e. face of the casing 30 facing the blade 24). The indentations 42A are shallow, i.e. typically of a depth D on the order of the tip clearance ε, and typically large in width W. The depth D is in a direction perpendicular to the casing inner surface 31, while the width W is in the plane of the casing inner surface 31, across the indentations. The depth D and width W are shown in FIGS. 3A to 4. In one embodiment, the width W and/or depth D of the indentations 42A may be same for each of the indentations, and/or may also be constant throughout the circumference of the casing 30 for each indentation. The indentations 42A may be continuous throughout the casing 30 (i.e. there is no blockage or interruption of the indentation), and may not communicate with each other. In one embodiment, the width W is at least twice the depth D. In another embodiment, the width W is at least four times the depth D.

The plurality of indentations 42A are defined over a region of the inner face 31 defined axially between a projection Ple of the leading edge 38 onto the casing inner face 31 and a projection Pte of the trailing edge 40 onto the casing inner face 31. In other words, between the projection Ple of the leading edge 38 onto the casing inner face 31 and the projection Pte of the trailing edge 40 onto the casing inner face 31, there are two or more indentations or indentations 42A defined in the inner face 31 of the casing 30. In some cases, one may alternatively define the region as being defined axially between a projection Ple of the leading edge 38 at a tip of the blade onto the casing inner face 31 and a projection Pte of the trailing edge 40 at a tip of the blade onto casing inner face 31. The indentations 42A could extend from the projection Pte to the projection Ple or could be at only a portion of the region defined axially between the projection Ple and the projection Pte.

In this embodiment, the indentations 42A are negative sawtooth shaped. It is however contemplated that the indentations 42A could have various shapes. For example, in FIG. 3B, the casing 30 has positive sawtooth shaped indentations 42B. In another example, in FIG. 3C, the casing 30 has constant width rectangular indentations 42C. The indentations 42B and 42C have otherwise similar features as the indentations 42A, for example in terms of depth D, width W. The indentations 42A could be rectangular, or a constant shape or pattern, or of a variable pattern. The indentations 42A could also not be circumferentially straight. Any circumferential shallow indentation of an order of magnitude of the clearance ε is contemplated.

The indentations 42A (resp. 42B, 42C) define ridges 43A (resp. 43B, 43C) therebetween. The ridges 43A (resp. 43B, 43C) are narrow. In one example, a width Wr of the ridges 43C is less than $1/5^{th}$ of the width W of the indentations 42C. The width Wr of the ridges 43C is defined at the inner surface 31. In the example of the ridges 43A, their width Wr may be 0. The ridges 43A (resp. 43B, 43C) of the indentations 42A (resp. 42B, 42C) may partially block the upstream component of the tip clearance flow Fl so as to reduce double tip leakage Fl2, and as a result decrease the sensitivity of aerodynamic performance and stability to tip clearance size. The shallowness of the indentations 42A (resp. 42B, 42C) may minimize any loss in nominal performance that the introduction of deeper indentations otherwise does. The shallowness of the indentations 42A (resp. 42B, 42C) may also avoid the need to thicken the casing 30 which may increase engine weight. Finally, the circumferential nature of the indentations 42A (resp. 42B, 42C) makes them easy to manufacture.

Turning now to FIGS. 5A to 7, plots show the results from single blade passage CFD simulations for a conventional double circular arc (DCA) axial compressor rotor with solid casing (no indentations) versus the casing 30 having the indentations 42A, 42B, 42C. The plots are shown normalised. The normalising quantities (labeled nominal) are computed for the case of the casing 30 having no indentation and the tip clearance ε nominal being the tip clearance at new (or minimal tip clearance).

Figure 5B:
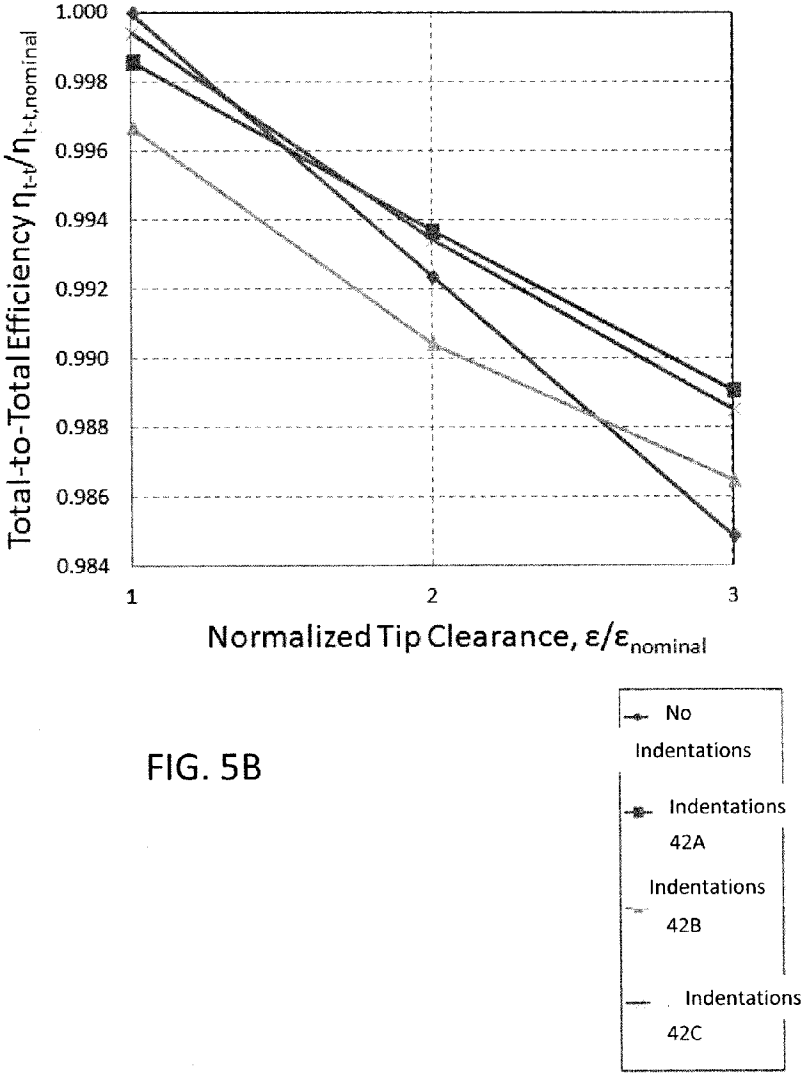
FIG. 5B is a plot of the normalised total to total efficiency ηt-t versus the normalised tip clearance ε for various casings.
Figure 5A:
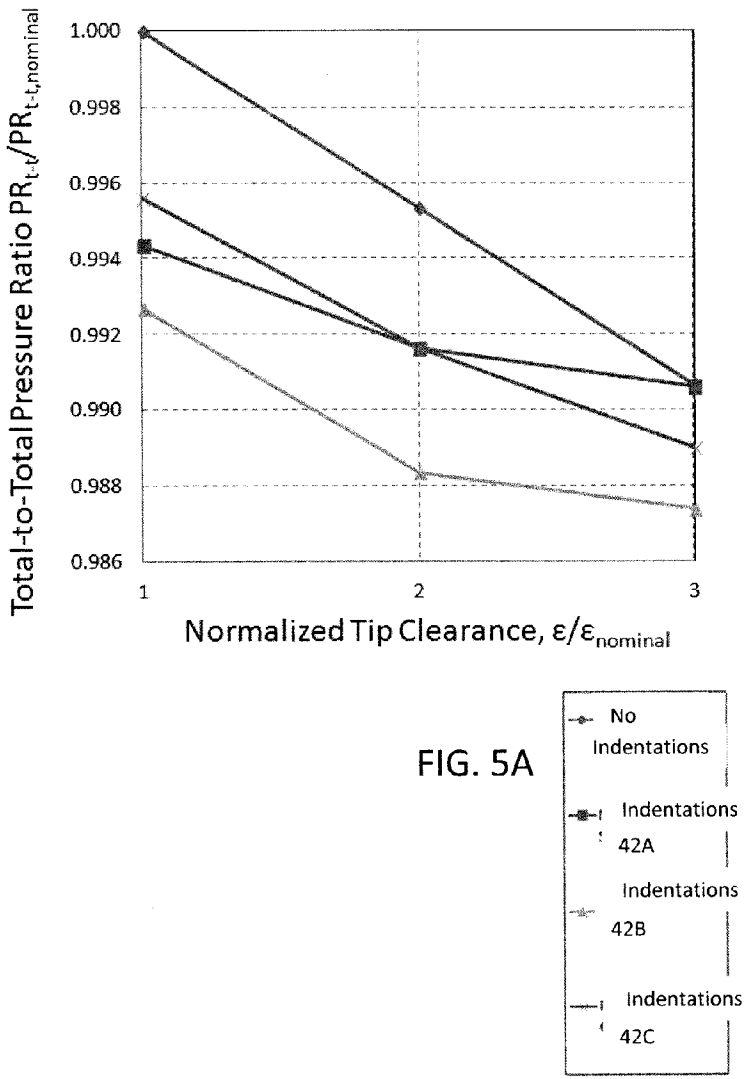
FIG. 5A is a plot of the normalised total to total pressure ratio PRt-t versus the normalised blade's tip clearance ε for various casings.

In FIG. 5A is plotted the normalised total-to-total pressure ratio PRt-t versus the normalised tip clearance ε.

The total pressure ratio is a ratio between the total pressure at the exit and entrance of the rotor 22. FIG. 5A shows that, as the tip clearance ε increases (for, for example, reasons described above), the total-to-total pressure ratio PRt-t decreases. However, this decrease is less when the indentations 42A, 42B, 42C are present compared to no indentations.

In FIG. 5B is plotted the normalised total-to-total efficiency ηt-t versus the normalised tip clearance ε. For any of the designs of the casing shown in the plot, the total-to-total efficiency ηt-t decreases when the tip clearance ε increases. Although, the nominal performance is slightly greater when the casing has no indentations than when it has the indentations 42A, 42B, 42C, when the tip clearance ε increases, the total to total efficiency ηt-t decreases less and its value becomes greater for the design with indentations 42A, 42B, 42C than with no indentations.

In summary, the slopes of the curves of pressure ratio and efficiency versus tip clearance ε represent the sensitivity to tip clearance of aerodynamic performance. The more negative the slope, the more sensitive the aerodynamic performance. The reduction of the slope in the pressure ratio and efficiency plots due to the presence of the indentations allows for a lesser sensitivity to tip clearance size and in turn an engine with more robustness in its performance.

Figure 6:
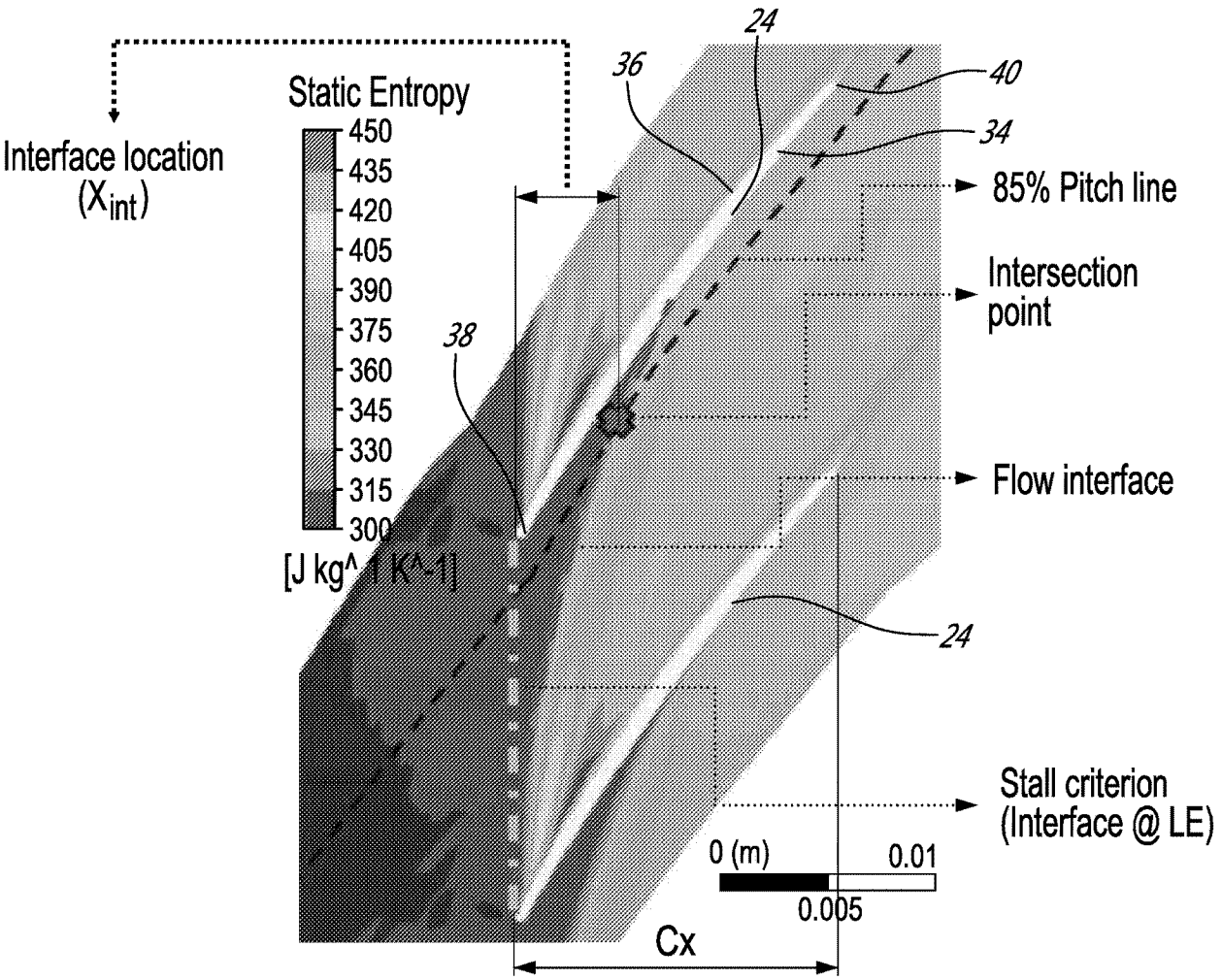
FIG. 6 is a plot of the static entropy of the flow as view from a top of the compressor rotor of FIG. 2.

In FIG. 6, a plot of the static entropy of the flow at the rotor 22 tip plane as view from a top of the rotor 22 allows to distinguish the flow F from the leakage flow Fl. The flow F is shown in dark grey areas of lower entropy, and the leakage flow Fl is shown in light grey areas of higher entropy (since the leakage flow has locally a higher entropy than the flow F). The localisation of the flows F, Fl relative to the blades 24 allows to determine the interface between the two flows F, Fl (illustrated by the curved dashed line separating the dark and light grey areas). A parameter related to the interface can be used to quantify this interface relative to the leading edges 38 of the blades 24 (illustrated by the straight dash-dot line). This parameter is Xint, and may be defined as the axial distance between the leading edges 38 of the blades 24 (illustrated by the straight dash-dot line) and the intersection point between the interface between the two flows F, Fl (illustrated by the curved dashed line separating the dark and light grey areas) and a 85% pitch line. Other definitions of the parameter Xint could be used.

Knowing the interface between the flows F, Fl allows to indirectly quantify stall/surge margin in the case of aerodynamic stability. The further the interface is from the leading edge at the rotor tip plane (i.e. the higher the interface location parameter Xint), the larger is the stall/surge margin.

Figure 7:
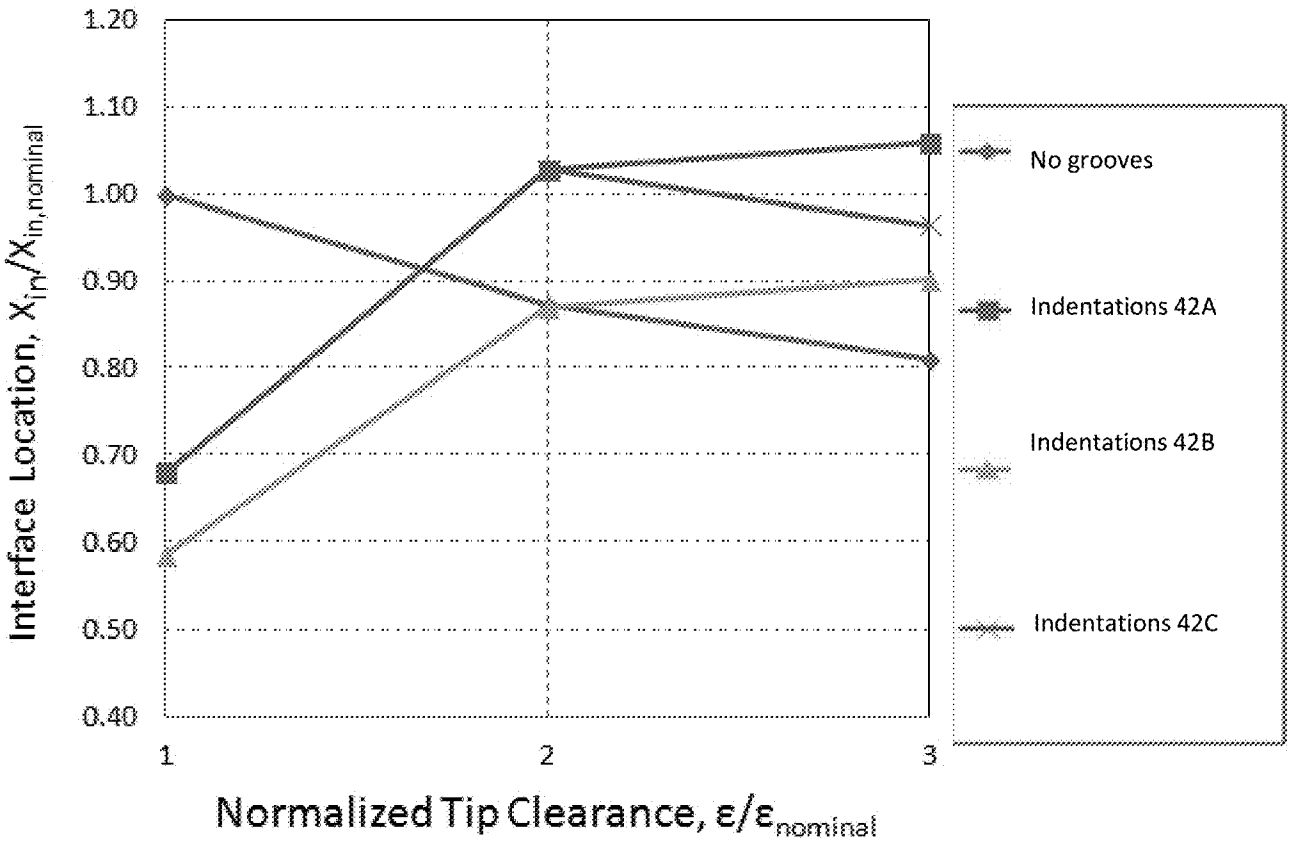
FIG. 7 is a plot of a normalised interface location parameter Xint versus the normalised tip clearance ε for various casings.

In FIG. 7, a plot of the normalised interface location parameter Xint (shown in FIG. 6) of the blade 24 illustrates the influence of the indentations on this parameter when tip clearance ε increases. When there are no indentations, the parameter Xint decreases, which means that the engine 10 has lower stall/surge margin. However, when the indentations 42A, 42B, 42C are introduced to the casing 30, the parameter Xint increases, which means that the engine 10 has higher stall/surge margin. As a result, the sensitivity of the stall/surge margin is reduced (in fact reversed in this case).

FIGS. 5A to 7 thus illustrate that the shallow circumferential indentations 42A, 42B, 42C may reduce the sensitivity to tip clearance ε of the aerodynamic performance and stall/surge margin even reversing the latter, i.e. increasing the stall/surge margin with tip clearance size ε (positive slope in FIG. 7) and may in turn have beneficial impact on both short-term and long-term gas turbine engine performance. While these results also point to a slight penalty in nominal aerodynamic performance and stability (pressure ratio, efficiency and stall/surge margin at minimum tip clearance) in the presence of the shallow indentations 42A, 42B, 42C, indentation design parameters such as shape, depth D, number, location and axial extent can be optimized to reduce or eliminate this penalty and further decrease sensitivity. To these two ends, the indentations may also be combined with desensitizing blade design strategies mentioned in Erler, E., 2013, "Axial Compressor Blade Design for Desensitization of Aerodynamic Performance and Stability to Tip Clearance", Doctoral Dissertation, Ecole Polytechnique de Montreal, January 2013, which is incorporated herein by reference.

The above indentations of the casing may reduce sensitivity to performance (pressure ratio and efficiency) and surge margin as tip clearance increases during running of the gas turbine engine.

The above description is meant to be exemplary only, and one skilled in the art will recognize that changes may be made to the embodiments described without departing from the scope of the invention disclosed. The above described indentations are not limited to axial compressor rotors but could be associated to any other all compressor blade rows which exhibit double tip leakage, including stator blade rows with hub clearance (where the indentations would be applied to the hub, and the clearance would be between the hub and an radial inward end of the stator blades), mixed flow rotors and centrifugal impellers. Still, other modifications which fall within the scope of the present invention will be apparent to those skilled in the art, in light of a review of this disclosure, and such modifications are intended to fall within the appended claims.

The invention claimed is:

1. A compressor shroud for surrounding one of a rotor and a stator of a compressor of a gas turbine engine, the one of the rotor and the stator having a plurality of radially extending airfoils, the shroud comprising:

an annular body defining an axial, a radial, and a circumferential direction, the annular body having a radially inner surface and a plurality of indentations annularly defined in the radially inner surface, at least one of the plurality of indentations being sawtooth shaped, the radially inner surface and the one of the rotor and the stator defining a clearance therebetween, each of the plurality of indentations having a depth in the radial direction, the depth and the clearance having a same order of magnitude, each of the plurality of indentations being an annular indentation that extends annularly along the circumferential direction, having a width in the axial direction greater than the depth, a ridge being located between two adjacent ones of the plurality of indentations, the ridge extending annularly along the circumferential direction and having a width in the axial direction being less than the width of each of the plurality of indentations, the plurality of indentations being provided in a region defined axially between projections of leading and trailing edges of the plurality of radially extending airfoils onto the radially inner surface of the annular body; wherein the plurality of indentations are configured to reduce a sensitivity of the gas turbine engine to pressure ratio, efficiency and surge margin as the clearance increases.

2. The shroud of claim 1, wherein each of the plurality of indentations is sawtooth shaped.

3. The shroud of claim 1, wherein each of the plurality of indentations has a continuous ring shape.

4. The shroud of claim 1, wherein the plurality of indentations are identical to each other.

5. The shroud of claim 1, wherein the width of each of the plurality of indentations is at least twice their depth.

6. The shroud of claim 5, wherein the width of each of the plurality of indentations is at least four times their depth.

7. The shroud of claim 1, wherein the width of the ridge is less than $1/5^{th}$ of the width of each of the plurality of indentations.

8. The shroud of claim 1, wherein the plurality of indentations extend throughout the entire region of the radially inner surface defined axially between the projections of the leading and trailing edges of the airfoils onto the radially inner surface of the annular body.

9. A gas turbine engine comprising:

a compressor including a stator and a rotor both having a plurality of radially extending airfoils; and an annular casing surrounding one of the stator and the rotor, the annular casing having:

an annular body defining an axial, a radial, and a circumferential direction, the annular body having a radially inner surface and a plurality of indentations annularly defined in the radially inner surface, at least one of the plurality of indentations being sawtooth shaped, the radially inner surface and the one of the rotor and the stator defining a clearance therebetween, the plurality of indentations having a depth in the radial direction, the depth and the clearance having a same order of magnitude, each of the plurality of indentations extending annularly along the circumferential direction and having a width in the axial direction greater than the depth, a ridge being located between two adjacent ones of the plurality of indentations, the ridge extending annularly along the circumferential direction and having a width in the axial direction being less than the width of each of the plurality of indentations, the plurality of indentations being defined in a region of the radially inner surface defined axially between projections of leading and trailing edges of the plurality of radially extending airfoils onto the radially inner surface of the annular body; wherein the plurality of indentations are configured to reduce a sensitivity of the gas turbine engine to pressure ratio, efficiency and surge margin as the clearance increases.

10. The gas turbine engine of claim 9, wherein each of the plurality of indentations is sawtooth shaped.

11. The gas turbine engine of claim 9, wherein the width of each of the plurality of indentations is at least twice their depth.

12. The gas turbine engine of claim 9, wherein the width of each of the plurality of indentations is at least four times their depth.

13. The gas turbine engine of claim 9, wherein the plurality of indentations is continuous.

14. The gas turbine engine of claim 9, wherein the width of the ridge is less than $1/5^{th}$ of the width of each of the plurality of indentations.

15. The gas turbine engine of claim 9, wherein the plurality of indentations extend throughout the entire region of the radially inner surface defined axially between the projections of the leading and trailing edges of the plurality of radially extending airfoils onto the radially inner surface of annular body.

16. A method of forming a compressor annular casing for surrounding one of a rotor and a stator of a compressor of a gas turbine engine, the method comprising:

forming a plurality of indentations, the plurality of indentations being annular and in an inner surface of an annular body of the compressor annular casing thereby creating a ridge between two adjacent ones of the plurality of indentations, at least one of the plurality of indentations being sawtooth shaped, the ridge extending annularly along a circumferential direction, the inner surface and the one of the rotor and the stator defining a clearance therebetween, a depth of the plurality of indentations in a radial direction and the clearance having a same order of magnitude, each of the plurality of indentations extending annularly along the circumferential direction and having a width in an axial direction greater than the depth, the ridge having a width in the axial direction being less than the width of each of the plurality of indentations, the plurality of indentations being provided in a region defined axially between projections onto the inner surface of the annular body of the compressor annular casing of leading and trailing edges of airfoils of the one of the rotor and the stator; wherein the plurality of indentations are configured to reduce a sensitivity of the gas turbine engine to pressure ratio, efficiency and surge margin as the clearance increases.

17. The method of claim 16, wherein forming the plurality of indentations comprises forming each of the plurality of indentations has sawtooth shaped indentations.

18. The method of claim 16, wherein forming the plurality of indentations comprises the forming of a plurality of continuous indentations.

19. The method of claim 16, wherein forming the plurality of indentations comprises forming indentations having the width of each of the plurality of indentations at least twice their depth.

* * * * *